US005988425A

United States Patent [19]

Yehl et al.

[11] Patent Number: 5,988,425

[45] Date of Patent: Nov. 23, 1999

[54] SIPPER CUP

[76] Inventors: Gregory Yehl, 1207 Kenilworth Trace, Snellville, Ga. 30078; James Keane, 434 Woodruff Crossing, Woodstock, Ga. 30189

[21] Appl. No.: 09/008,771

[22] Filed: Jan. 19, 1998

[51] Int. Cl.[6] ..... B65D 51/16

[52] U.S. Cl. ..... 220/303; 215/11.4; 220/705; 220/714; 220/717; 222/490

[58] Field of Search ..... 220/703, 705, 220/711, 717, 714; 215/11.5, 11.4, DIG. 7, 270, 271, 354; 222/719, 721, 490, 494

[56] References Cited

U.S. PATENT DOCUMENTS

| | | | |
|---|---|---|---|
| 2,557,817 | 6/1951 | Schlensinger | 222/490 |
| 2,584,359 | 2/1952 | Miles | 215/11.4 |
| 2,736,446 | 2/1956 | Raiche | 215/11.5 |
| 5,099,998 | 3/1992 | Curzon et al. | 215/6 X |
| 5,100,930 | 3/1992 | Fukui et al. | 523/100 |
| 5,140,053 | 8/1992 | Yamamoto et al. | 521/142 |
| 5,542,670 | 8/1996 | Morano | 220/253 X |
| 5,607,073 | 3/1997 | Forrer | 215/11.4 |

*Primary Examiner*—Allan N. Shoap
*Assistant Examiner*—Joe Merek

[57] ABSTRACT

A sipper cup including a cup assembly having a plurality of threaded grooves formed adjacent a top opening thereof. Further provided is a cap assembly having a spout integrally formed on an upper surface thereof. The cap assembly is equipped with a plurality of threaded grooves for allowing the screwable coupling of the cap assembly with the cup assembly. Such threaded grooves of the cap assembly and the cup assembly are adapted to allow air to pass therethrough. Also included is an elastomeric insert including a spout valve for allowing fluid to exit the spout of the cap assembly only upon the application of suction. In use, air is allowed to enter the cup through the threaded grooves thus compensating for the vacuum formed in the cup assembly upon the exiting of fluid from the spout.

9 Claims, 6 Drawing Sheets

SIPPER CUP

BACKGROUND OF THE INVENTION

1. Field of the Invention

The present invention relates to a sipper cup and more particularly pertains to allowing the entrance of air within a sipper cup via the screwable coupling between a cup and cap assembly thereof for equalizing a vacuum generated upon the exiting of fluid therefrom.

2. Description of the Prior Art

The use of spill-proof cups is known in the prior art. More specifically, spill-proof cups heretofore devised and utilized for the purpose of preventing the inadvertent spillage of liquid from a cup are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,079,013 to Belanger which discloses a dripless liquid feeding/training container with spring actuated valves and an air inlet valve situated on a top face of the cap assembly thereof.

U.S. Pat. No. 5,542,670 to Morano discloses a spill-proof container with an elastomeric member with cavities situatable over a spout and an air inlet hole thereof. The elastomeric member is equipped with intersecting slits for allowing the passage of fluid through the spout and air inlet hole only upon the application of pressure thereto.

U.S. Pat. No. 4,138 to Pratt teaches a nursing bottle with an elastomeric plug which is adapted to couple a cap assembly and cup assembly thereof. Such plug has a first aperture for allowing liquid communication between the cap and cup assemblies thereof and a second aperture for allowing fluid communication between the cup assembly and an exterior.

U.S. Pat. No. 4,836,404 to Coy disclose a valved container closure with a valve having a V-shaped configuration which is adapted to open upon the application of pressure thereto.

U.S. Pat. No. 5,186,347 to Freeman et al. discloses a spill-proof closure having a spout containing a thin membrane near an upper end thereof. The thin member has a slit formed therein which remains closed except upon the application of pressure.

Lastly, U.S. Patent Des. 324,105 and U.S. Patent Des 165,778 are provided as being of general interest.

In this respect, the sipper cup according to the present invention substantially departs from the conventional concepts and designs of the prior art, and in so doing provides an apparatus primarily developed for the purpose of allowing the entrance of air within a sipper cup via the screwable coupling between a cup and cap assembly thereof for equalizing a vacuum generated upon the exiting of fluid therefrom.

Therefore, it can be appreciated that there exists a continuing need for a new and improved sipper cup which can be used for allowing the entrance of air within a sipper cup via the screwable coupling between a cup and cap assembly thereof for equalizing a vacuum generated upon the exiting of fluid therefrom. In this regard, the present invention substantially fulfills this need.

SUMMARY OF THE INVENTION

In view of the foregoing disadvantages inherent in the known types of spill-proof cups now present in the prior art, the present invention provides an improved sipper cup. As such, the general purpose of the present invention, which will be described subsequently in greater detail, is to provide a new and improved sipper cup which has all the advantages of the prior art and none of the disadvantages.

To attain this, the present invention essentially comprises a cup assembly having a circular bottom face and cylindrical periphery defining a circular top opening. The cup assembly further has a plurality of threaded grooves formed in an outer surface of the periphery adjacent the top opening thereof. Further provided is a cap assembly including a circular top face with a lip integrally coupled to a periphery thereof which depends downwardly therefrom. The cap assembly has a spout integrally formed on the top face adjacent the periphery thereof. The spout includes a hollow interior with a generally rectangular configuration and a plurality of egress apertures formed in a top extent thereof. The cap assembly also has an annular flange integrally formed on a lower surface of the top face thereof opposite the spout. For allowing the screwable coupling of the cap assembly with the cup assembly, the lip of the cap assembly has a plurality of threaded grooves formed therein. For reasons that will become apparent later, the threaded grooves of the cap assembly and the cup assembly are sized such that air is allowed to pass to therethrough. Finally, an elastomeric insert is provided having a disk-shaped configuration. In use, the insert is adapted for being inserted between the cup assembly and cap assembly. The insert includes a spout valve with a rectangular configuration integrally formed adjacent a periphery of the insert and in a perpendicular relationship therewith. The spout valve has deformable front and rear walls. Formed in the insert adjacent the front and rear walls of the spout valve is a plurality of flow apertures. By such structure, when the spout valve is inserted within the spout of the cap assembly in an operative orientation, the front and rear walls of the spout valve collapse upon the application of a suction to the egress apertures of the spout. Such collapsing allows fluid to flow through the flow apertures of the insert to the egress apertures. To allow a user to selectively place the spout valve in its operative orientation, the elastomeric insert further includes a generally rectangular cut out formed in a central extent thereof. A periphery of the rectangular cut out has a semicircular tab integrally coupled thereto and resides in coplanar relationship with the insert. Such flap is integrally formed on a bottom surface of the insert and depends downwardly therefrom. A circular inset portion is formed in an upper surface of the insert for frictionally engaging the annular flange of the cap assembly. Such frictional engagement is imperative for maintaining the spout valve in its operative orientation upon the removal of the cap assembly from the cup assembly. An oval inset portion is formed in the bottom face of the insert adjacent the periphery thereof opposite the spout valve. The oval inset portion has a length greater than the thickness of the periphery of the cup assembly. This inequality is imperative for allowing air drawn through the screwable coupling of the cap and cup assembly to enter the cup thus compensating for the vacuum formed in the cup assembly upon the exiting of fluid from the spout.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sipper cup which has all the advantages of the prior art spill-proof cups and none of the disadvantages.

It is another object of the present invention to provide a new and improved sipper cup which may be easily and efficiently manufactured and marketed.

It is a further object of the present invention to provide a new and improved sipper cup which is of a durable and reliable construction.

An even further object of the present invention is to provide a new and improved sipper cup which is susceptible of a low cost of manufacture with regard to both materials and labor, and which accordingly is then susceptible of low prices of sale to the consuming public, thereby making such sipper cup economically available to the buying public.

Still yet another object of the present invention is to provide a new and improved sipper cup which provides in the apparatuses and methods of the prior art some of the advantages thereof, while simultaneously overcoming some of the disadvantages normally associated therewith.

Still another object of the present invention is to allow the entrance of air within a sipper cup via the screwable coupling between a cup and cap assembly thereof for equalizing a vacuum generated upon the exiting of fluid therefrom.

Yet another object of the present invention is to provide a sipper cup equipped with a one-way spout valve absent springs, slits and the like.

Lastly, it is an object of the present invention to provide a new and improved sipper cup including a cup assembly having a plurality of threaded grooves formed adjacent a top opening thereof. Further provided is a cap assembly having a spout integrally formed on an upper surface thereof. The cap assembly is equipped with a plurality of threaded grooves for allowing the screwable coupling of the cap assembly with the cup assembly. Such threaded grooves of the cap assembly and the cup assembly are adapted to allow air to pass therethrough. Also included is an elastomeric insert including a spout valve for allowing fluid to exit the spout of the cap assembly only upon the application of suction. In use, air is allowed to enter the cup through the threaded grooves thus compensating for the vacuum formed in the cup assembly upon the exiting of fluid from the spout.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
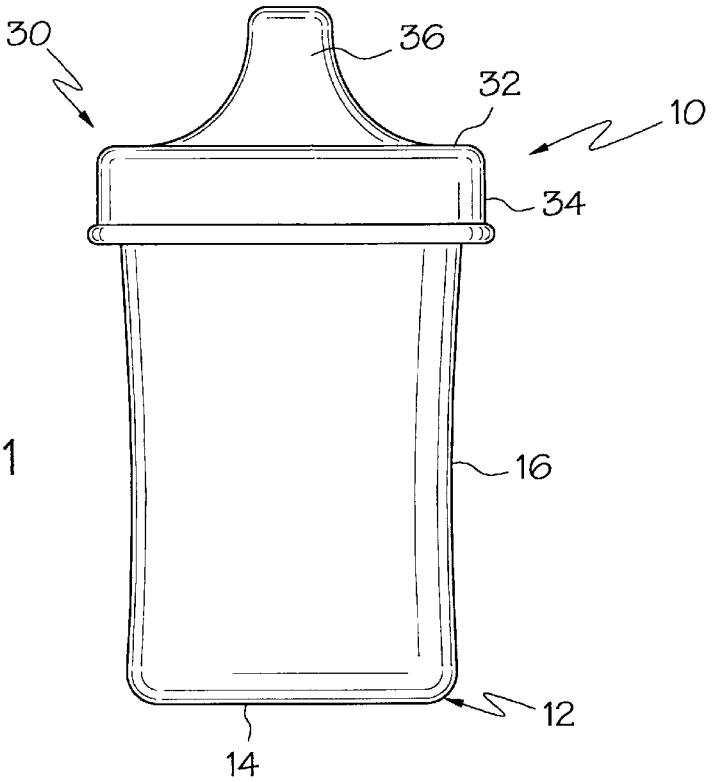
FIG. 1 is an illustration of the preferred embodiment of the sipper cup constructed in accordance with the principles of the present invention.

With reference now to the drawings, and in particular to FIG. 1 thereof, a new and improved sipper cup embodying the principles and concepts of the present invention and generally designated by the reference numeral 10 will be described.

The present invention, the new and improved sipper cup, is comprised of a plurality of components. Such components in their broadest context include a cup assembly, a cap assembly, and an elastomeric insert. Such components are individually configured and correlated with respect to each other so as to attain the desired objective.

Figure 2:
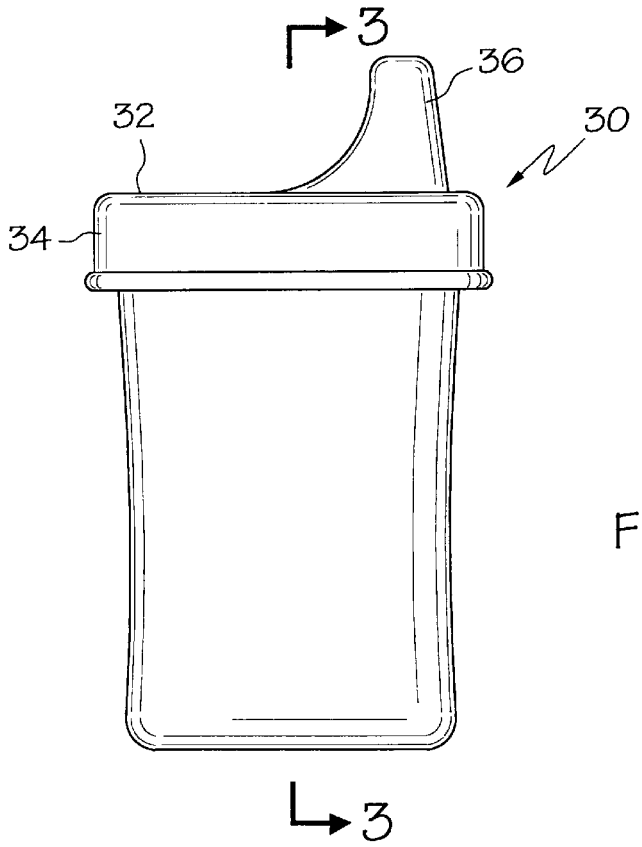
FIG. 2 is a side elevational view of the cup assembly and cap assembly in an assembled orientation.
Figure 4:
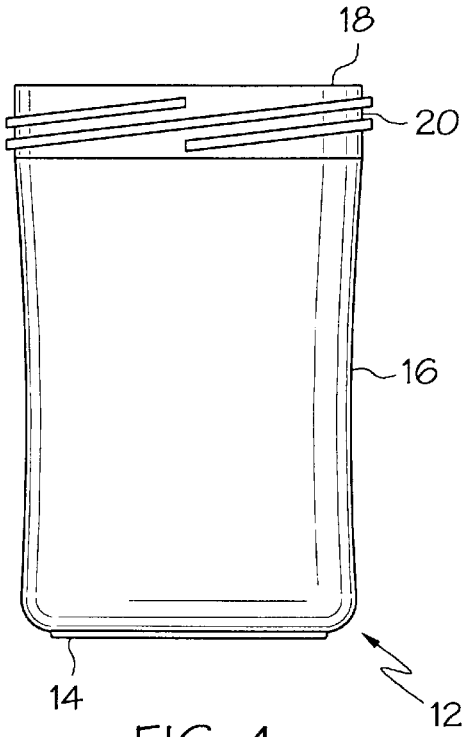
FIG. 4 is a side elevational view of the cup assembly depicting the threaded grooves thereof.
Figure 14:
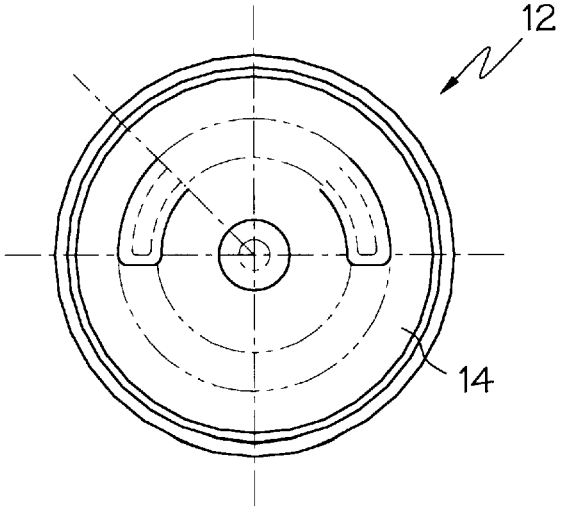
FIG. 14 is a top view of the cup assembly without the cap assembly placed thereon.

More specifically, it will be noted that the system 10 of the present invention includes a cup assembly 12 having a circular bottom face 14 and cylindrical periphery 16 defining a circular top opening 18. It should be noted that the cup assembly is preferably constructed to contain either 6 or 9 ounces of fluid. As shown in FIG. 4, the cup assembly 12 further has a plurality of threaded grooves 20 formed in an outer surface of the periphery adjacent the top opening thereof. As shown in FIGS. 1 & 2, the periphery of the cup assembly is ideally slightly curvilinear from top to bottom. For strengthening purposes, the circular bottom face has a pair of arcuate ribs formed thereon within the interior space of the cup assembly. Such ribs are preferably situated in concentric relationship with the circular bottom face. Further, each rib defines an arc of approximately 45 degrees. Note FIG. 14.

Figure 5:
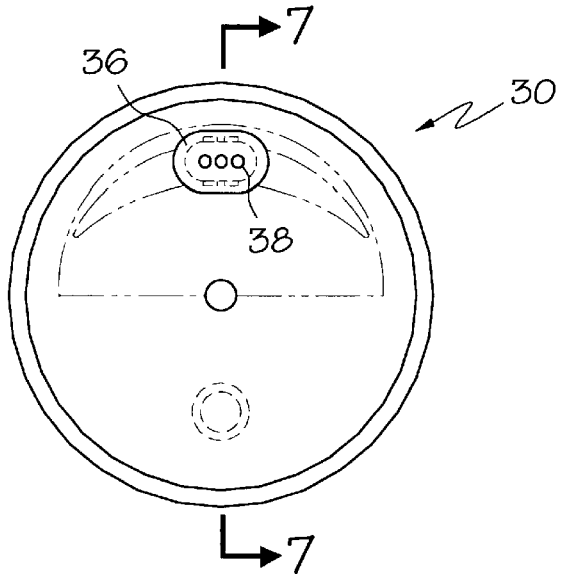
FIG. 5 is a cross-sectional view of the cap assembly illustrating the bottom surface thereof.
Figure 6:
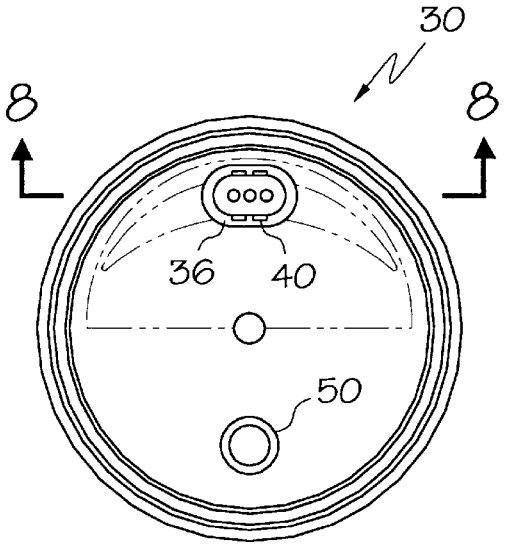
FIG. 6 is another cross-sectional view of the cap assembly illustrating the bottom surface thereof.

Further provided is a cap assembly 30 including a circular top face 32 with a lip 34 integrally coupled to a periphery thereof and extended downwardly therefrom. The cap assembly 30 has a spout 36 integrally formed on an upper surface of the top face adjacent the periphery thereof. As shown in the Figures, the top wall tapers upwardly to form the spout 36. The spout 36 includes a hollow interior with a generally rectangular configuration and a plurality of egress apertures 38 formed in a top extent thereof, 95 As seen best in FIGS. 5, 6 and 7. Such hollow interior has a bottom opening situated flush with the top face of the cap assembly. A lower extent of the hollow interior is equipped with a plurality of vertical channels 40.

Figure 7:
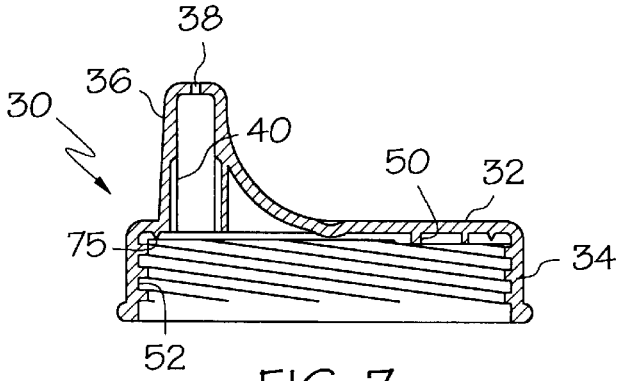
FIG. 7 is a cross-sectional view of the cap assembly taken along line 7—7 shown in FIG. 5.
Figure 8:
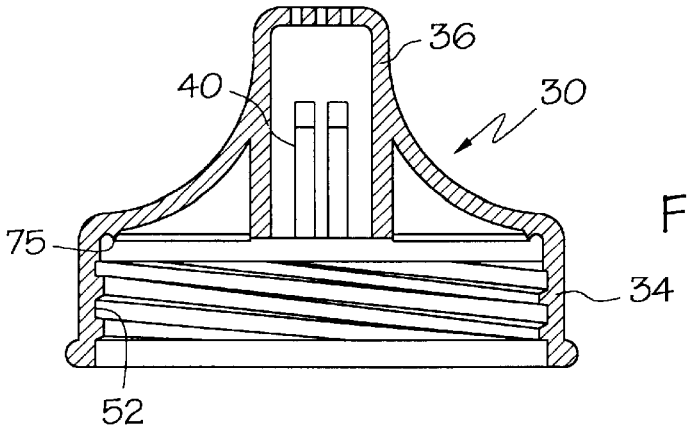
FIG. 8 is a cross-sectional view of the cap assembly taken along line 8—8 shown in FIG. 6.
Figure 9:
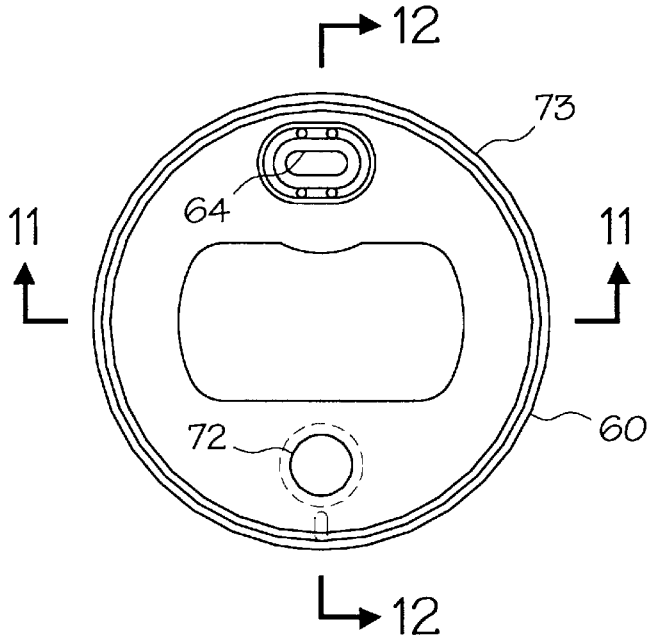
FIG. 9 is a top plan view of the elastomeric insert of the present invention.
Figure 10:
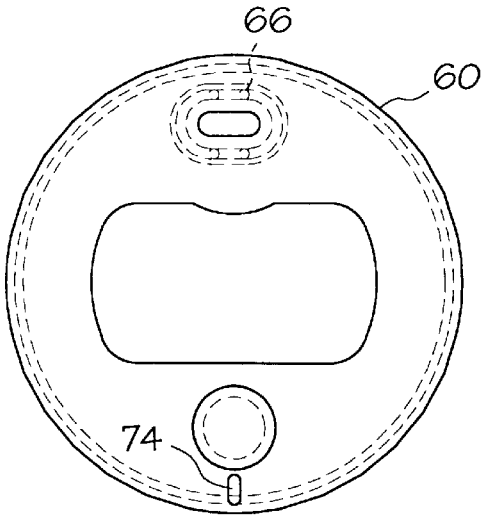
FIG. 10 is a bottom view of the elastomeric insert of the present invention.
Figure 11:
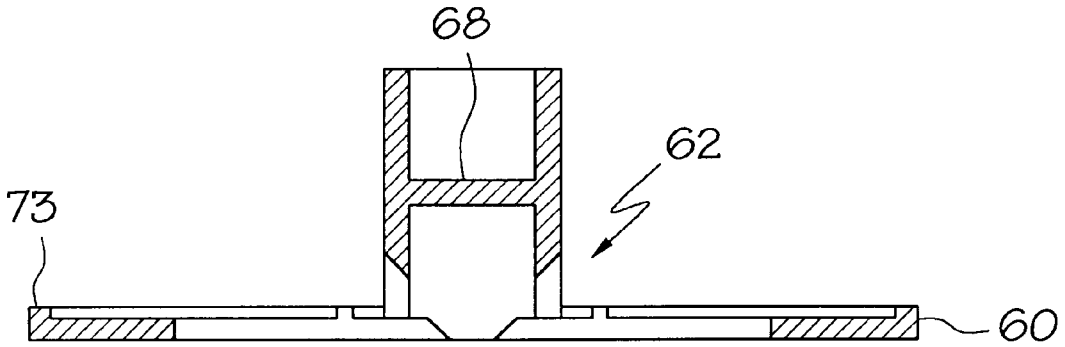
FIG. 11 is a cross-sectional view of the elastomeric insert of the present invention taken along line 11—11 shown in FIG. 9.
Figure 12:
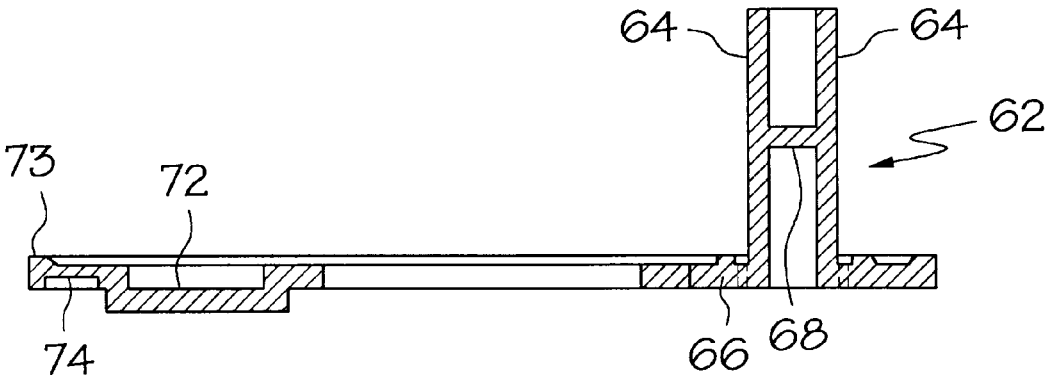
FIG. 12 is a cross-sectional view of the elastomeric insert of the present invention taken along line 12—12 shown in FIG. 9.

As shown in FIG. 7, the cap assembly 30 also has an annular flange 50 integrally formed on a lower surface of the top face thereof opposite the spout 36. To allow the screwable coupling of the cap assembly 30 with the cup assembly 12, the lip of the cap assembly has a plurality of threaded grooves 52 formed therein. For reasons that will become apparent later, the threaded grooves of the cap assembly and the cup assembly are sized such that air is allowed to pass to therethrough. As can be best seen in FIGS. 3 & 4, air may enter in a lowermost portion of a threaded groove and thereafter flow to the interior of the cup assembly through a space 54 defined in a top extent of each threaded groove of the cup assembly. Ideally, the cap assembly is fabricated of general purpose AMOCO polypropylene from homopolymers with about 1% of a conventional slip agent and about ¾% of a conventional blowing agent. Ideally, the cup assembly is fabricated from AMOCO clarified polypropylene random polymer.

Finally, an elastomeric insert 60 is provided having a disk-shaped configuration. Ideally, the elastomeric insert 60 is of a size and shape similar to the top face of the cap assembly and is entirely formed of a flexible material. Further, the valve is preferably constructed from silicone or, in the alternative, latex, santoprene or kraton. In use, the insert 60 is adapted for being inserted between the cup assembly 12 and cap assembly 30, thereby affording a seal between a majority of the cap and cup assemblies.

The insert 60 includes a spout valve 62 with a rectangular configuration integrally formed adjacent a periphery of the insert 60 and in a perpendicular relationship therewith. The spout valve 62 has deformable front and rear walls 64. Formed in the insert 60 adjacent the front and rear walls 64 is a plurality of flow apertures 66. It is imperative that fluid not be allowed to flow between the front and rear walls. To preclude such flow and further allow the walls to exhibit flexibility, a horizontal divider 68 is integrally formed between the front and rear walls at a central extent thereof. By such structure, when the spout valve 62 is inserted within the spout 36 of the cap assembly 30 in an operative orientation, the front and rear walls 64 of the spout valve 62 provide a seal to preclude the loss of fluid when not in use. Such front and rear walls 64 of the spout valve 62 further collapse upon the application of a suction to the egress apertures of the cup assembly. Such collapsing allows fluid to flow through the flow apertures 66 of the insert 60 to the egress apertures. It should be noted that it is only necessary for the front and rear walls of an upper extent of the spout valve to be biased inwardly. This is so because the lower extent of the spout of the cap assembly is equipped with the channels 40 thereby providing passages adjacent the front and rear walls of the spout valve. As shown in the Figures, such passages are in alignment with the flow apertures of the insert 60.

To allow a user to selectively place the spout valve 62 in its operative orientation, the elastomeric insert 60 further includes a generally rectangular cut out formed in a central extent thereof. A periphery of the rectangular cut out has a semicircular tab integrally coupled thereto and resides in coplanar relationship with the insert. A circular inset portion 72 is formed in an upper surface of the insert for frictionally engaging the annular flange 50 of the cap assembly 30. Such frictional engagement is imperative for maintaining the spout valve 62 in its operative orientation upon the removal of the cap assembly 30 from the cup assembly 12.

Figure 3:
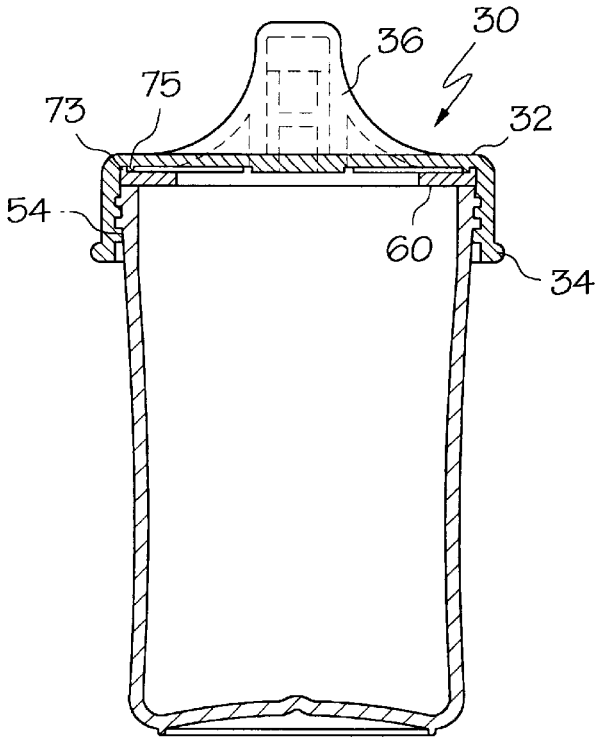
FIG. 3 is a cross-sectional view of the present invention in an assembled orientation taken along line 3—3 shown in FIG. 2.

Working in conjunction with the circular inset portion 72 and the annular flange 50 is a peripheral lip 73 extending upwardly from the upper surface of the insert. Integrally formed on a lower surface of the top face of the cap assembly is an annular protrusion 75 with a V-shaped cross-section. Such annular protrusion has a diameter that is less than that of the periphery lip 73 of the insert. As such, the annular protrusion 75 abuts the peripheral lip 73 during use, as shown in FIG. 3.

Figure 13:
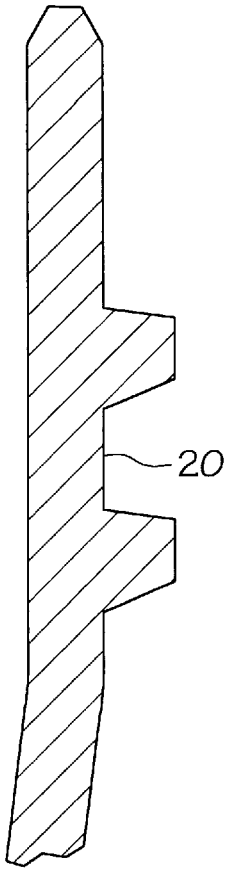
FIG. 13 is a cross-sectional view of a top edge of the cup assembly.

An oval inset portion 74 is formed in the bottom face of the insert 60 adjacent the periphery thereof opposite the spout valve 62. The oval inset portion 74 has a length greater than the thickness of the periphery of the cup assembly 12. This inequality is imperative for allowing air that is drawn through the screwable coupling of the cup and cap assemblies to enter the cup thus compensating for the vacuum formed in the cup assembly 12 upon the exiting of fluid from the spout 36. To further facilitate the transfer of air through the passage afforded by the oval inset portion 74, an inner and outer surface of a top edge of the cup assembly is bevelled to afford a reduced thickness. Note FIG. 13.

The present invention thus provides a sipper cup which affords a unique method providing air equalization during use. The elastomeric insert is also easily removed and cleaned after use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sipper cup comprising, in combination:

a cup assembly having a circular bottom face and a cylindrical periphery defining a circular top opening, the cup assembly further having a plurality of threaded grooves formed in an outer surface of the periphery adjacent the top opening thereof;

a cap assembly including a circular top face with a lip integrally coupled to a periphery thereof which depends downwardly therefrom, the cap assembly having a spout integrally formed on an upper surface of the top face adjacent the periphery thereof, the spout including a hollow interior with a generally rectangular configuration and a plurality of egress apertures formed in a top extent thereof, the cap assembly also having an annular flange integrally formed on a lower surface of the top face opposite the spout, the lip having a plurality of threaded grooves for allowing the screwable coupling of the cap assembly with the cup assembly, the threaded grooves of the cap assembly and the cup assembly being sized such that air is allowed to pass to therethrough; and an elastomeric insert having a disk-shaped configuration for being inserted between the cup assembly and cap assembly during use, the insert including a spout valve which acts as a valve when inserted in the spout of the cap assembly integrally formed adjacent a periphery of the insert and in a perpendicular relationship therewith, the spout valve having deformable front and rear walls with a horizontal spacer formed therebetween and vertical channels formed therein extending above the horizontal spacer, and a plurality of flow apertures formed in the insert adjacent the front and rear walls such that when the spout valve is inserted within the spout of the cap assembly, the front and rear walls of the spout valve collapse upon the application of a suction to the egress apertures thereof thus allowing fluid to flow through the flow apertures of the insert to the egress apertures, the elastomeric insert further including a generally rectangular cut out formed in a central extent thereof with a periphery having a semicircular tab integrally coupled thereto and residing in coplanar relationship with the insert for allowing a user to selectively place the spout valve in its operative orientation, a circular inset portion formed in an upper surface of the insert for frictionally engaging the annular flange of the cap assembly thereby maintaining the spout valve in its operative orientation upon the removal of the cap assembly from the cup assembly, and an oval inset portion formed in the bottom face of the insert adjacent the periphery thereof opposite the spout valve, the oval inset portion having a length greater than the thickness of the periphery of the cup assembly for allowing air to enter the cup thus compensating for the vacuum formed in the cup assembly upon the exiting of fluid from the spout.

2. A sipper cup comprising:

a cup assembly having a plurality of threaded grooves formed adjacent a top opening thereof;

a cap assembly having a spout integrally formed on an upper surface thereof and a lip integrally coupled to a periphery of the upper surface which depends downwardly therefrom, the lip further having a plurality of threaded grooves for allowing the screwable coupling of the cap assembly with the cup assembly, the threaded grooves of the cap assembly and the cup assembly shaped to allow air to pass therethrough; and an elastomeric insert including a spout valve for allowing fluid to exit the spout of the cap assembly upon the application of a suction thereto and whereby air is allowed to enter the cup through the threaded grooves thus compensating for a vacuum formed in the cup assembly upon the exiting of fluid from the spout; wherein the elastomeric insert is of a similar shape as a top face of the cap assembly and provides a seal between a majority of the cap assembly and the cup assembly thereby precluding fluid to exit therethrough; wherein the insert includes an oval inset portion formed in a bottom face thereof on a periphery of the insert thereof opposite the spout valve, the oval inset portion having a length greater than the thickness of the periphery of the cup assembly; wherein the spout valve of the elastomeric insert has deformable front and rear walls and a plurality of flow apertures formed in the insert adjacent the front and rear walls so that when the spout valve is inserted within the spout of the cap assembly, the front and rear walls of the spout valve collapse upon application of a suction to the spout thus allowing fluid to flow through the flow apertures of the insert to the egress apertures.

3. A sipper cup as set forth in claim 2 wherein the elastomeric insert further includes a generally rectangular cut out formed in a central extent thereof with a periphery having a semicircular tab integrally coupled thereto and residing in coplanar relationship with the insert for allowing a user to selectively place the spout valve in the spout of the cup assembly.

4. A sipper cup as set forth in claim 2 wherein the cap assembly has an annular flange formed in a bottom surface thereof and further the insert includes a circular inset portion formed in an upper surface thereof for frictionally engaging the annular flange of the cap assembly thereby maintaining the spout valve in the spout of the cup assembly upon the removal of the cap assembly from the cup assembly.

5. A sipper cup as set forth in claim 2 wherein the cap assembly is fabricated of clarified polypropylene from copolymers.

6. The sipper cup as set forth in claim 5 wherein the cap appembly also includes about 1% of a conventional slip agent and about ¾% of a conventional blowing agent.

7. A sipper cup comprising:

a cup assembly;

a cap assembly having a spout integrally formed on an upper surface thereof, the cap assembly including threads formed therein to couple the cap assembly to the cup assembly;

an elastomeric insert including a spout valve for allowing fluid to exit the spout of the cap assembly upon the application of suction thereto, the spout valve having deformable walls and a plurality of flow apertures formed in the insert adjacent the deformable walls, the front and rear walls shaped so that when the spout valve is inserted within the spout of the cap assembly, the deformable walls of the spout valve collapse upon the application of a suction to the spout of the cap assembly thus allowing fluid to flow through the flow apertures of the insert to the egress apertures; and air inlet means for allowing air to enter the cup thus compensating for the vacuum formed in the cup assembly upon the exiting of fluid from the spout.

8. A sipper cup comprising:

a cup assembly having a plurality of threaded grooves formed adjacent a top opening thereof;

a cap assembly having a spout integrally formed on an upper surface thereof and a lip integrally coupled to a periphery of the upper surface which depends downwardly therefrom, the lip further having a plurality of threaded grooves for allowing the screwable coupling of the cap assembly with the cup assembly, the threaded grooves of the cap assembly and the cup assembly shaped to allow air to pass therethrough; and an elastomeric insert including a spout valve having deformable front and rear walls and a plurality of flow apertures formed in the insert adjacent the front and rear walls, the front and rear walls shaped so that when the spout valve is inserted within the spout of the cap assembly the front and the rear walls collapse allowing fluid to flow through the apertures and exit the spout of the cap assembly upon application of a suction thereto and whereby air is allowed to enter the cup through the threaded grooves thus compensating for a vacuum formed in the cup assembly upon the exiting of fluid from the spout.

9. A sipper cup comprising:

a cup assembly having a plurality of threaded grooves formed adjacent a top opening thereof;

a cap assembly having a spout integrally formed on an upper surface thereof and a lip integrally coupled to a periphery of the upper surface which depends downwardly therefrom, the lip further having a plurality of threaded grooves for allowing the screwable coupling of the cap assembly with the cup assembly, the threaded grooves of the cap assembly and the cup assembly shaped to allow air to pass therethrough; and an elastomeric insert including a spout valve for allowing fluid to exit the spout of the cap assembly upon application of a suction thereto and a generally rectangular cutout formed in a central extent thereof with a periphery having a semicircular tab integrally coupled thereto and residing in a coplanar relationship with the insert for allowing a user to selectively place the spout valve in the spout of the cap assembly and whereby air is allowed to enter the cup through the threaded grooves thus compensating for a vacuum formed in the cup assembly upon the exiting of fluid from the spout.

* * * * *